US010722939B2

(12) United States Patent
Marcin et al.

(10) Patent No.: US 10,722,939 B2
(45) Date of Patent: Jul. 28, 2020

(54) PRODUCTION OF MULTI-PASSAGE HOLLOW CASTING

(71) Applicant: United Technologies Corporation, Farmington, CT (US)

(72) Inventors: John Joseph Marcin, Marlborough, CT (US); Steven J. Bullied, Pomfret Center, CT (US); Santosh Ranganath, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 171 days.

(21) Appl. No.: 16/023,896

(22) Filed: Jun. 29, 2018

(65) Prior Publication Data

US 2020/0001353 A1 Jan. 2, 2020

(51) Int. Cl.

| | |
|---|---|
| ***B22C 9/04*** | (2006.01) |
| ***B22C 9/12*** | (2006.01) |
| ***B22C 9/24*** | (2006.01) |
| ***B22C 9/10*** | (2006.01) |
| ***B22C 1/10*** | (2006.01) |
| ***B22C 1/16*** | (2006.01) |
| *B22F 3/24* | (2006.01) |

(52) U.S. Cl.

CPC ..... *B22C 9/10* (2013.01); *B22C 1/10* (2013.01); *B22C 1/16* (2013.01); *B22C 9/043* (2013.01); *B22C 9/24* (2013.01); *B22F 2003/248* (2013.01)

(58) Field of Classification Search

CPC .. B22C 9/04; B22C 9/043; B22C 9/12; B22C 9/24

See application file for complete search history.

(56) References Cited

U.S. PATENT DOCUMENTS

| | | | | |
|---|---|---|---|---|
| 4,047,882 | A * | 9/1977 | Morita | B22C 9/12 432/9 |
| 4,754,798 | A | 7/1988 | Chandley et al. | |
| 6,845,811 | B2 * | 1/2005 | Yang | B22C 9/04 164/361 |
| 9,950,358 | B2 | 4/2018 | Yang et al. | |
| 2018/0056376 | A1 | 3/2018 | Bochiechio et al. | |

FOREIGN PATENT DOCUMENTS

| | | | |
|---|---|---|---|
| CN | 109047673 | A | 12/2018 |

OTHER PUBLICATIONS

Search Report dated Sep. 3, 2019 in U421434EP, EP Application No. EP19183670, 4 pages.

* cited by examiner

*Primary Examiner* — Kevin E Yoon
(74) *Attorney, Agent, or Firm* — Cantor Colburn LLP

(57) ABSTRACT

A method of fabricating a casting is provided. The method includes creating a mixture of ceramic powder and a binder, pouring the mixture around sacrificial patterns, executing a first thermal treatment to set the mixture into a solid mold without damaging the sacrificial patterns, executing a second thermal treatment to remove the sacrificial patterns without removing any of the binder from the solid mold, executing at least one of a third thermal treatment and a chemical treatment to remove a quantity of the binder to transform the solid mold into a solid breakaway mold and pouring molten metallic material into the solid breakaway mold.

20 Claims, 4 Drawing Sheets

PRODUCTION OF MULTI-PASSAGE HOLLOW CASTING

BACKGROUND

Exemplary embodiments of the present disclosure relate generally to hollow castings and, in one embodiment, to method of producing multi-passage hollow castings.

Many castings have hollow passages that are difficult to cast. In some cases, the difficulty can arise from passages being so small or narrow that an investment casting slurry cannot be effectively applied in multiple layers with intermittent drying to allow for sufficient strength to be developed to withstand fluid flow dynamics and hydrostatic pressures of poured molten metal. On the other hand, in aluminum casting, a very fluid mold material like gypsum can be poured into intricate passages to have sufficient strength to form a "solid mold" structure. Rather than sequentially dip this material with intermittent drying, this material is poured all at once with chemical activation to dry the material to form the "solid mold" around a master wax pattern that forms the component. Once the wax is removed, aluminum is poured into the mold to allow the aluminum to solidify. Once solidified, the solid mold material is mechanically removed.

It has been observed, however, that no such processes exist for iron, nickel, cobalt base or other high temperature castings. In these or other cases, separate ceramic cores must be made (if possible), inserted into the component wax (or other material) pattern during injection and then sent through conventional investment casting sequential dip layer processes. This significantly increases manufacture lead time and cost.

BRIEF DESCRIPTION

According to an aspect of the disclosure, a method of fabricating a casting is provided. The method includes creating a mixture of ceramic powder and a binder, pouring the mixture around sacrificial patterns, executing a first thermal treatment to set the mixture into a solid mold without damaging the sacrificial patterns, executing a second thermal treatment to remove the sacrificial patterns without removing any of the binder from the solid mold, executing at least one of a third thermal treatment and a chemical treatment to remove a quantity of the binder to transform the solid mold into a solid breakaway mold and pouring molten metallic material into the solid breakaway mold.

In accordance with additional or alternative embodiments, the ceramic powder includes a refractory material and the binder includes a self-setting binder.

In accordance with additional or alternative embodiments, the method further includes assembling a casting pour-cup with gating to the sacrificial patterns.

In accordance with additional or alternative embodiments, the pouring includes pouring the mixture around an entirety of exposed portions of the sacrificial patterns.

In accordance with additional or alternative embodiments, the pouring includes at least one of agitation, vibration, ultrasonic pressure and suction or vacuum.

In accordance with additional or alternative embodiments, the method further includes pouring the mixture around the sacrificial patterns within a rigid container.

In accordance with additional or alternative embodiments, at least one of the third thermal treatment and the chemical treatment remove about 10% or less of the binder from the solid mold.

In accordance with additional or alternative embodiments, at least one of the third thermal treatment and the chemical treatment remove about 30% or more of the binder from the solid mold.

In accordance with additional or alternative embodiments, a temperature of the metallic material is less than a slumping temperature of the solid breakaway mold.

In accordance with additional or alternative embodiments, the method further includes allowing the molten material to cool into a metallic component within the solid breakaway mold and breaking the solid breakaway mold away from the metallic component following cooling.

According to another aspect of the disclosure, a method of fabricating a casting is provided and includes creating a mixture of ceramic powder and a binder, assembling sacrificial patterns to a casting pour-cup with gating in a rigid container, pouring the mixture into the rigid container in a single pour around an entirety of exposed portions of the sacrificial patterns, executing a first thermal treatment to set the mixture into a solid mold without thermally damaging the sacrificial patterns, executing a second thermal treatment to remove the sacrificial patterns without thermally or chemically removing any of the binder from the solid mold, executing at least one of a third thermal treatment and a chemical treatment to remove a quantity of the binder to transform the solid mold into a solid breakaway mold and pouring molten metallic material into the solid breakaway mold.

In accordance with additional or alternative embodiments, the ceramic powder includes a refractory material and the binder comprises a self-setting binder.

In accordance with additional or alternative embodiments, the pouring includes at least one of agitation, vibration, ultrasonic pressure and suction or vacuum.

In accordance with additional or alternative embodiments, at least one of the third thermal treatment and the chemical treatment remove about 10% or less of the binder from the solid mold.

In accordance with additional or alternative embodiments, at least one of the third thermal treatment and the chemical treatment remove about 30% or more of the binder from the solid mold.

In accordance with additional or alternative embodiments, a temperature of the metallic material is less than a slumping temperature of the solid breakaway mold.

In accordance with additional or alternative embodiments, the method further includes allowing the molten material material to cool into a metallic component within the solid breakaway mold and breaking the solid breakaway mold away from the metallic component following cooling.

According to yet another aspect of the disclosure, a method of fabricating a casting is provided and includes creating a mixture of refractory powder and a self-setting binder, assembling sacrificial patterns to a casting pour-cup with gating in a rigid container, pouring the mixture into the rigid container in a single pour around an entirety of exposed portions of the sacrificial patterns, executing at least one of a three-part thermal treatment and a two-part thermal treatment with a chemical treatment to set the mixture into a solid mold without thermally damaging the sacrificial patterns, to remove the sacrificial patterns without thermally or chemically removing any of the binder from the solid mold and to remove a quantity of the binder to transform the solid mold into a solid breakaway mold, pouring molten metallic material, which is coolable into a metallic component, into the solid breakaway mold and breaking the solid mold away from the metallic component.

In accordance with additional or alternative embodiments, the pouring includes at least one of agitation, vibration, ultrasonic pressure and suction or vacuum.

In accordance with additional or alternative embodiments, at least one of the third thermal treatment and the chemical treatment remove about 10% or less or 30% or more of the binder from the solid mold.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

As will be described below, ceramic powder that is similar in composition to ceramic cores (e.g., silica, zircon, alumina, alumino-silicate, etc.) can be mixed with self-setting binders, such as urethanes and epoxies, to make very fluid ceramic mixtures. These ceramic mixtures can be poured around wax or rapid prototyping (RP) patterns to create a solid mold structure. This solid mold structure can fill and permeate small passages in order to make high temperature castings with complex internal passages relatively quickly and at relatively lower cost than if other methods were used. Vacuum and agitation could be used to assist the penetration and fill processing. The solid mold structure would be self-setting to harden when the binder hardens. The solid ceramic mold could be created in or placed in a metal flask. The wax pattern would be removed and the binder holding the ceramic particles together could then be removed chemically and/or thermally to create porosity. The amount of hardener can be increased for more porosity for crushability and permeability or decreased for improved strength. Once the solid mold is sufficiently hardened, molten metal would be poured in the mold to create a high temperature casting.

With reference to FIGS. 1-8, a method of fabricating a casting or, more particularly, a multi-passage hollow casting is provided.

Figure 1:
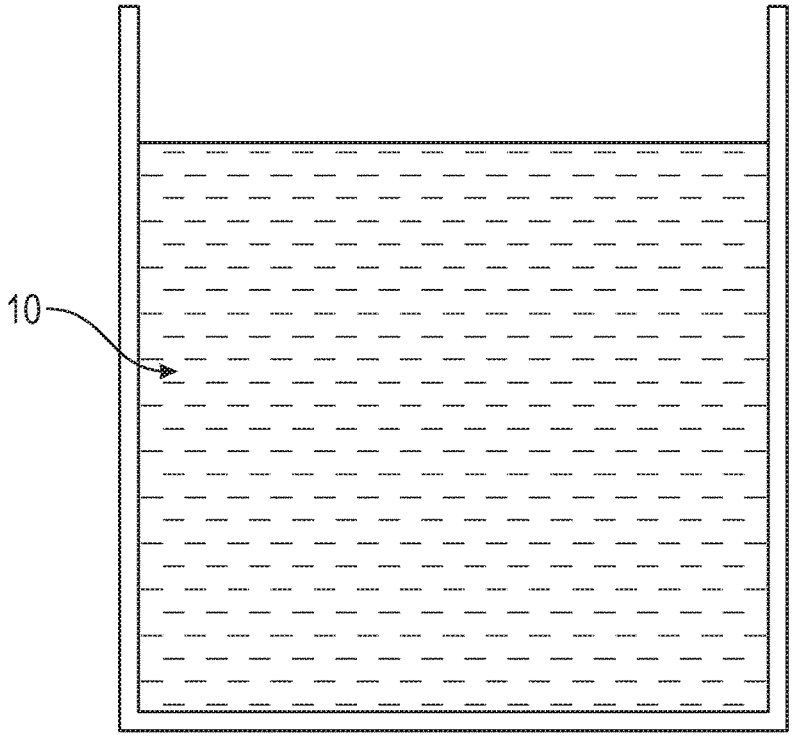
FIG. 1 is a schematic illustration of a mixture in accordance with embodiments.
Figure 2:
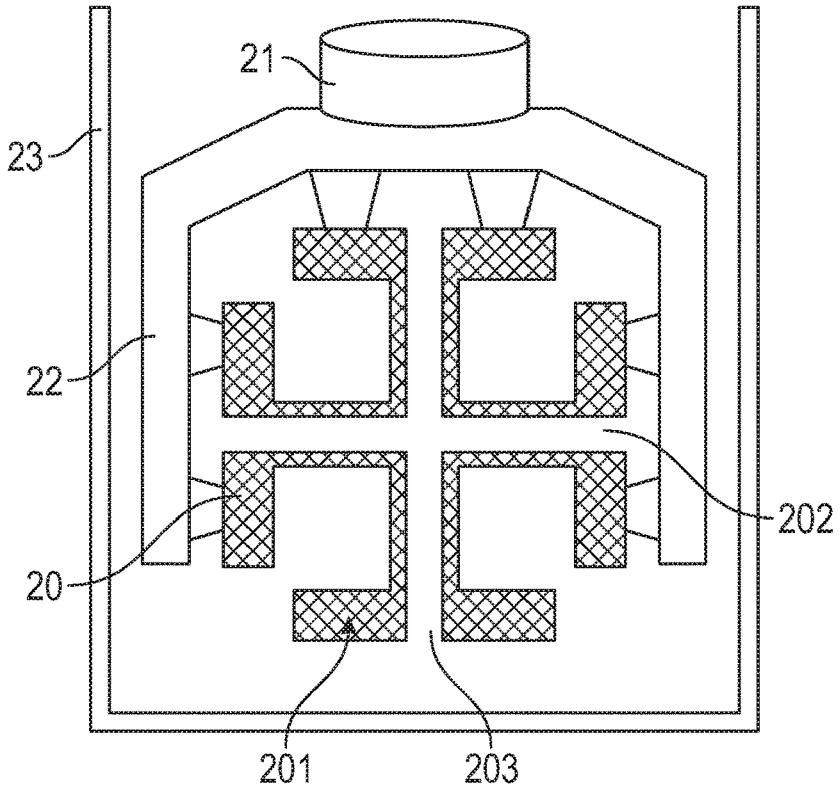
FIG. 2 is a schematic illustration of sacrificial patterns to which a pour-cut with gating is assembled and which is placed in a rigid container in accordance with embodiments.

As shown in FIGS. 1 and 2, the method initially includes preparatory operations of creating a mixture 10 of ceramic powder and a binder and assembling sacrificial patterns 20 to a casting pour-cup 21 with gating 22 in a rigid container 23. The ceramic powder can include or be provided as refractory materials including, but not limited to, silica, zircon, alumina, alumino-silicate, etc. The binder can include or be provided as a self-setting binder and may be organic. The binder can include or be provided as a urethane or an epoxy. The binder 10 is, at least initially, a fluid of relatively low viscosity that can be poured around and into the sacrificial patterns 20. The sacrificial patterns 20 can include or be provided with wax or rapid prototyping materials and can be formed into a shape of a structural cast component. The gating 22 provides for multiple flow paths from the pour-cup 21 to an interior of the sacrificial patterns 20. The rigid container 23 may include metallic material.

In accordance with embodiments, openings from the gating 22 to the interior of the sacrificial patterns 20 may be about 0.5 inches wide and the viscosity of the mixture 10 should be consistent with an ability of the mixture 10 to flow through openings of this size. Of course, the openings can be decreased in size with a corresponding increase in viscosity of the mixture 10. Conversely, the openings can be increased in size as well.

The sacrificial patterns 20 of FIGS. 2-8 is illustrated as a hollow potent cross 201 with horizontal and vertical central cavities 202 and 203. This is being done for purposes of clarity and brevity and it is to be understood that other embodiments of the sacrificial patterns 20 can be used.

Figure 3:
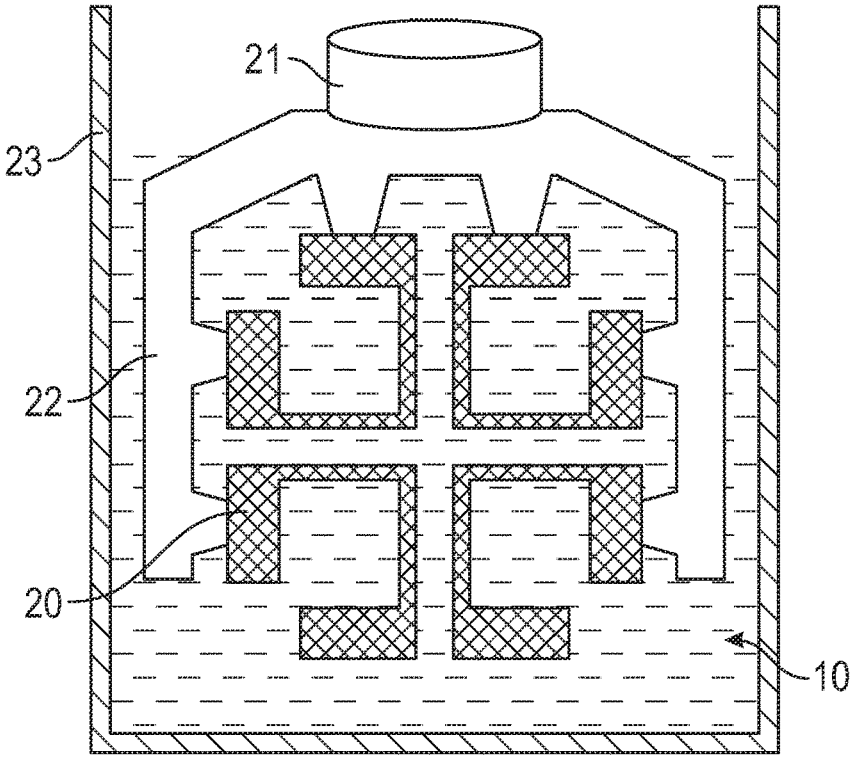
FIG. 3 is a side view of the mixture of FIG. 1 poured around an entirety of the sacrificial patterns of FIG. 2 within the rigid container of FIG. 2.

As shown in FIG. 3, the mixture 10 is poured in a single pour operation around the proximal portions of the gating 22 and around and into an entirety of the portions of the sacrificial patterns 20 that are exposed by the gating 22 inside the rigid container 23. In accordance with embodiments, the single pour operation can be paired with an agitation, a vibration, an ultrasonic pressurization, a suction or a vacuum or any other similar process that promotes movement and flow of the mixture 10 around and into the portions of the sacrificial patterns 20 (e.g., around the potent cross 201 and into the horizontal and vertical cavities 202 and 203).

Figure 4:
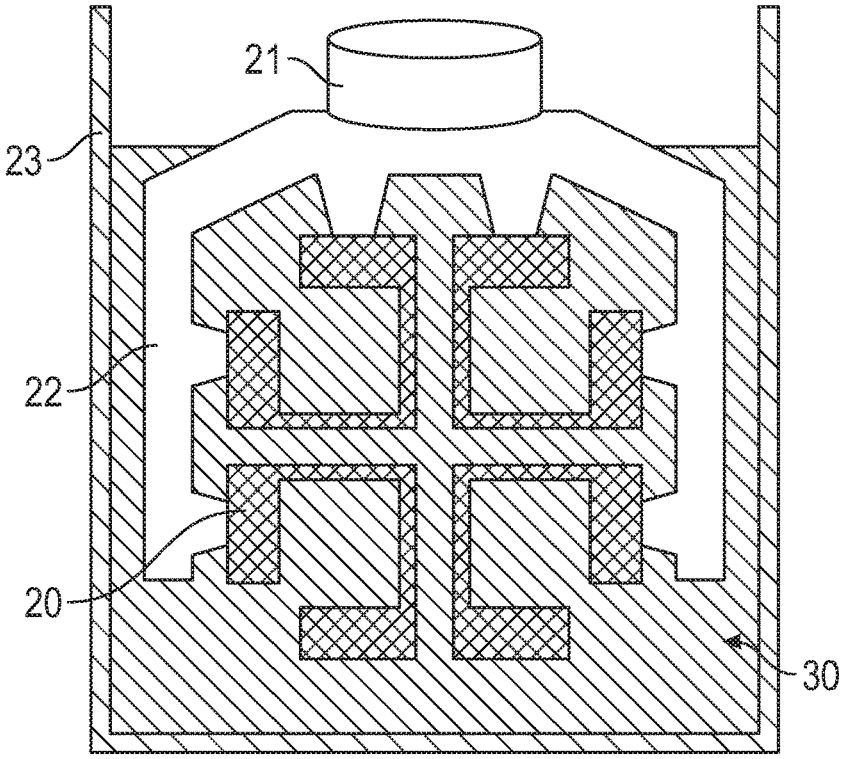
FIG. 4 is a side view of the mixture of FIG. 3 having been set into a solid mold in accordance with embodiments.

As shown in FIG. 4, a first thermal treatment is executed with respect to the mixture 10 to thus set and convert the mixture 10 into a solid mold 30. This first thermal treatment is a relatively low temperature thermal treatment, which is designed to activate the binder in the mixture 10 without otherwise damaging the sacrificial patterns 20.

Figure 5:
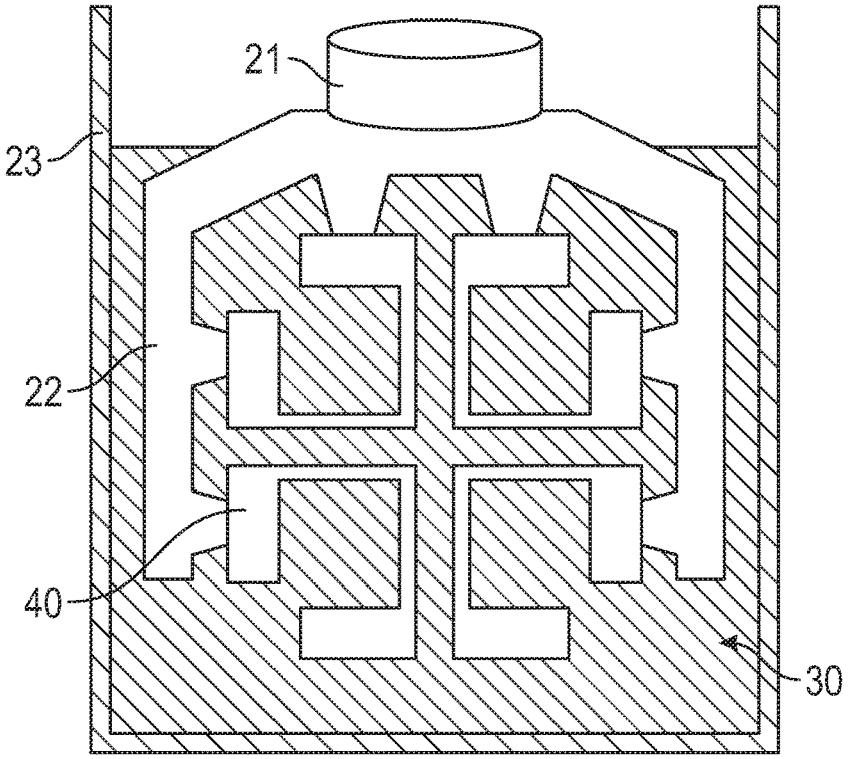
FIG. 5 is a side view of the sacrificial patterns having been removed in accordance with embodiments.

As shown in FIG. 5, a second thermal treatment is executed and causes the sacrificial patterns 20 to be removed from the solid mold 30 without removing any or at least a significant amount of the binder from the solid mold 30. The removal of the sacrificial patterns 20 leaves an open or empty region 40 that is fluidly communicative with the gating 22 and the pour-cup 21.

Figure 6:
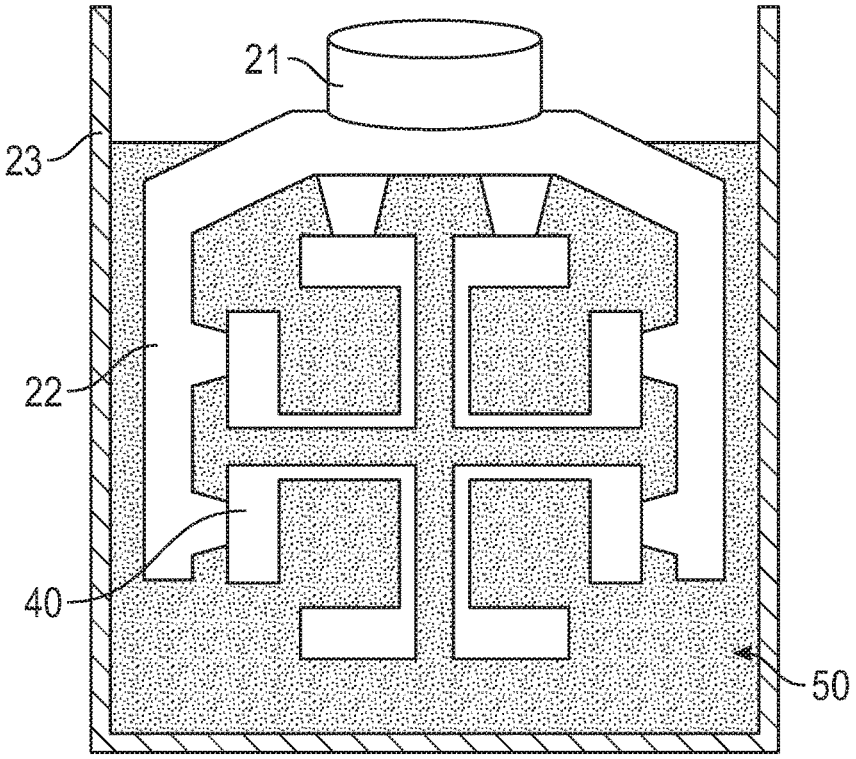
FIG. 6 is a side view of the solid mold having been formed into a solid breakaway mold in accordance with embodiments.

As shown in FIG. 6, at least one of a third thermal treatment and a chemical treatment is then executed to remove a predefined quantity of the binder from the solid mold 30 to thus convert the solid mold 30 into a solid breakaway mold 50. In accordance with embodiments, the predefined quantity of the binder to be removed can be determined based on a desired property of the solid breakaway mold. For example, at least one of the third thermal treatment and the chemical treatment could remove about 30% or more of the binder from the solid mold 30 in order to promote increased permeability and crushability of the solid breakaway mold 50. Conversely, the at least one of the third thermal treatment and the chemical treatment remove about 10% or less of the binder from the solid mold 30 in order to promote increased strength of the solid breakaway mold 50.

Figure 7:
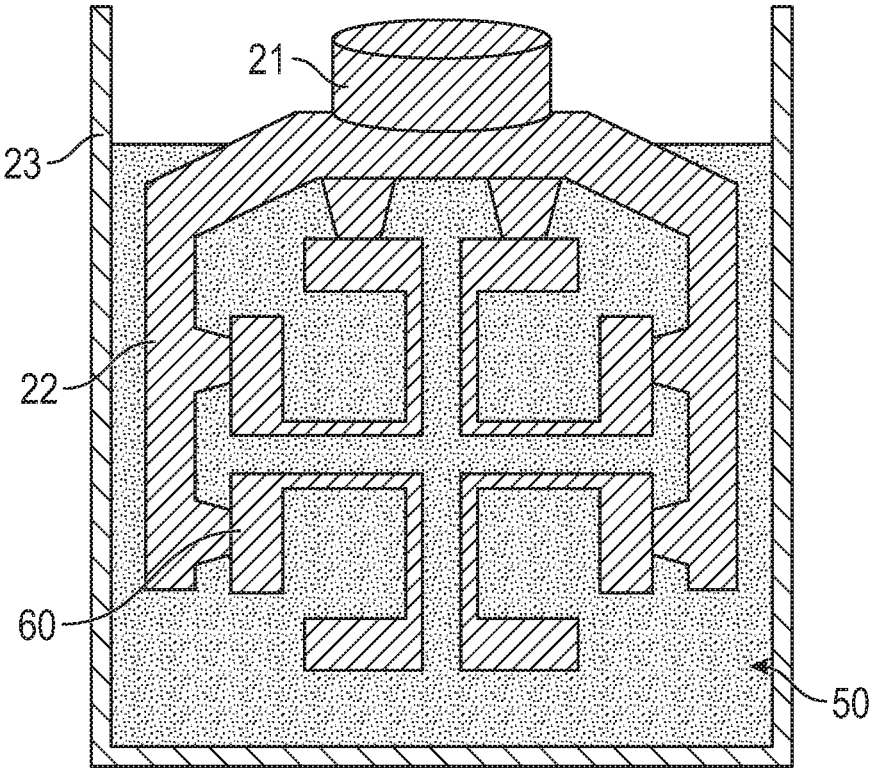
FIG. 7 is a side view of metallic material having been flown into the region formerly occupied by the sacrificial patterns in accordance with embodiments.

As shown in FIG. 7, molten metallic material at a temperature up to but not in excess of the slumping temperature of the solid breakaway mold 50 (e.g., about 3,000° F.) is poured into the pour-cup 21, the gating 22 and the empty region 40 formerly occupied by the sacrificial patterns 20. The molten metallic material is cooled to form a metallic component 60 in the shape of the sacrificial patterns 20 (e.g., in the shape of the hollow potent cross 201 with the horizontal and vertical cavities 202 and 203).

Figure 8:
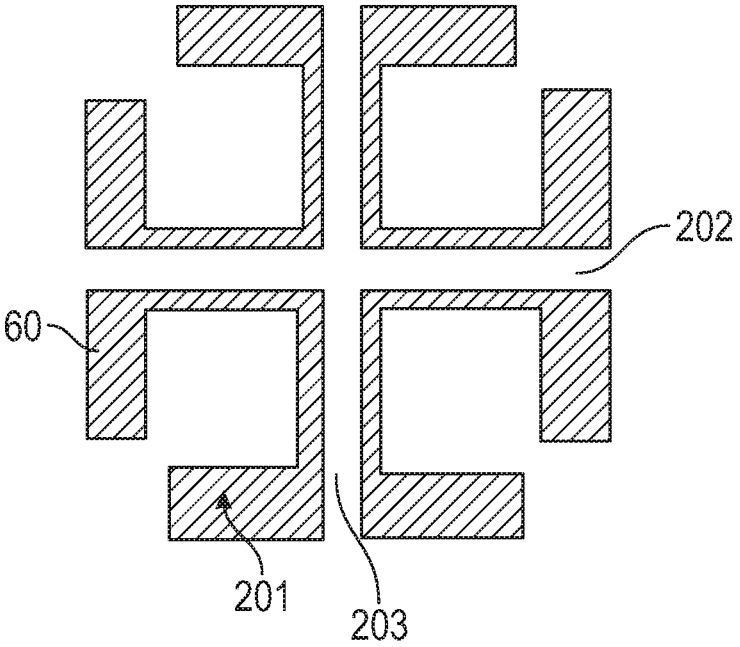
FIG. 8 is a side view of the metallic material with the solid breakaway mold, the pour-cup and the gating having been broken away in accordance with embodiments.

As shown in FIG. 8, once the molten metallic material is cooled and the metallic component 60 is formed, the solid breakaway mold 50 is broken away from the metallic component 60 (leaving only the hollow potent cross 201 shape with the horizontal and vertical cavities 202 and 203).

Benefits of the features described herein are the provision of castings that would conventionally require cores but which can be produced without cores at a more rapid rate and much lower cost that otherwise possible. The processes would not need expensive core tooling and can be used to create complex or simple molds. In particular, it should be understood that whereas normal casting processes can require multiple days of processing, the process of FIGS. 1-8 can be completed in a single day.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of fabricating a casting, the method comprising:

creating a mixture of ceramic powder and a binder;

pouring the mixture around sacrificial patterns;

executing a first thermal treatment to set the mixture into a solid mold without damaging the sacrificial patterns;

executing a second thermal treatment to remove the sacrificial patterns without removing any of the binder from the solid mold;

executing at least one of a third thermal treatment and a chemical treatment to remove a quantity of the binder to transform the solid mold into a solid breakaway mold; and pouring molten metallic material into the solid breakaway mold.

2. The method according to claim 1, wherein the ceramic powder comprises a refractory material and the binder comprises a self-setting binder.

3. The method according to claim 1, further comprising assembling a casting pour-cup with gating to the sacrificial patterns.

4. The method according to claim 1, wherein the pouring comprises pouring the mixture around an entirety of exposed portions of the sacrificial patterns.

5. The method according to claim 1, wherein the pouring comprises at least one of agitation, vibration, ultrasonic pressure and suction or vacuum.

6. The method according to claim 1, further comprising pouring the mixture around the sacrificial patterns within a rigid container.

7. The method according to claim 1, wherein the at least one of the third thermal treatment and the chemical treatment remove about 10% or less of the binder from the solid mold.

8. The method according to claim 1, wherein the at least one of the third thermal treatment and the chemical treatment remove about 30% or more of the binder from the solid mold.

9. The method according to claim 1, wherein a temperature of the metallic material is less than a slumping temperature of the solid breakaway mold.

10. The method according to claim 1, further comprising:

allowing the molten material to cool into a metallic component within the solid breakaway mold; and breaking the solid breakaway mold away from the metallic component following cooling.

11. A method of fabricating a casting, the method comprising:

creating a mixture of ceramic powder and a binder;

assembling sacrificial patterns to a casting pour-cup with gating in a rigid container;

pouring the mixture into the rigid container in a single pour around an entirety of exposed portions of the sacrificial patterns;

executing a first thermal treatment to set the mixture into a solid mold without thermally damaging the sacrificial patterns;

executing a second thermal treatment to remove the sacrificial patterns without thermally or chemically removing any of the binder from the solid mold;

executing at least one of a third thermal treatment and a chemical treatment to remove a quantity of the binder to transform the solid mold into a solid breakaway mold; and pouring molten metallic material into the solid breakaway mold.

12. The method according to claim 11, wherein the ceramic powder comprises a refractory material and the binder comprises a self-setting binder.

13. The method according to claim 11, wherein the pouring comprises at least one of agitation, vibration, ultrasonic pressure and suction or vacuum.

14. The method according to claim 11, wherein the at least one of the third thermal treatment and the chemical treatment remove about 10% or less of the binder from the solid mold.

15. The method according to claim 11, wherein the at least one of the third thermal treatment and the chemical treatment remove about 30% or more of the binder from the solid mold.

16. The method according to claim 11, wherein a temperature of the metallic material is less than a slumping temperature of the solid breakaway mold.

17. The method according to claim 11, further comprising:

allowing the molten material to cool into a metallic component within the solid breakaway mold; and breaking the solid breakaway mold away from the metallic component following cooling.

18. A method of fabricating a casting, the method comprising:

creating a mixture of refractory powder and a self-setting binder;

assembling sacrificial patterns to a casting pour-cup with gating in a rigid container;

pouring the mixture into the rigid container in a single pour around an entirety of exposed portions of the sacrificial patterns;

executing at least one of a three-part thermal treatment and a two-part thermal treatment with a chemical treatment to set the mixture into a solid mold without thermally damaging the sacrificial patterns, to remove the sacrificial patterns without thermally or chemically removing any of the binder from the solid mold and to remove a quantity of the binder to transform the solid mold into a solid breakaway mold;

pouring molten metallic material, which is coolable into a metallic component, into the solid breakaway mold; and breaking the solid mold away from the metallic component.

19. The method according to claim 18, wherein the pouring comprises at least one of agitation, vibration, ultrasonic pressure and suction or vacuum.

20. The method according to claim 18, wherein the at least one of the third thermal treatment and the chemical treatment remove about 10% or less or 30% or more of the binder from the solid mold.

* * * * *